United States Patent [19]

Kobayashi et al.

[11] Patent Number: 4,878,573

[45] Date of Patent: Nov. 7, 1989

[54] A COIN SEPARATOR HAVING A PROJECTING WALL FOR AUGMENTING THE SEPARATION OF COINS OF DIFFERENT DIAMETERS

[75] Inventors: Osamu Kobayashi, Tsurugashima; Koji Yukimoto, Sakado, both of Japan

[73] Assignee: Kabushiki Kaisha Nippon Conlux, Tokyo, Japan

[21] Appl. No.: 170,967

[22] Filed: Mar. 18, 1988

[30] Foreign Application Priority Data

Mar. 26, 1987 [JP] Japan ..... 62-44479[U]
Apr. 1, 1987 [JP] Japan ..... 62-49766[U]

[51] Int. Cl.[4] ..... G07D 5/02; G07F 3/04; G07F 1/04

[52] U.S. Cl. ..... 194/338; 194/346; 453/15

[58] Field of Search ..... 194/334, 338, 344, 347, 194/346; 453/9, 14, 15, 3; 193/31 R, 31 A, 32, DIG. 1; 198/956

[56] References Cited

U.S. PATENT DOCUMENTS 3,724,689 4/1973 Sugawara et al. ..... 193/31 A X
4,106,610 8/1978 Heiman ..... 194/97 R
4,286,703 9/1981 Schuller et al. ..... 194/100 A

FOREIGN PATENT DOCUMENTS 177000 12/1953 Austria ..... 194/338
595872 4/1934 Fed. Rep. of Germany ..... 194/338
3007484 9/1981 Fed. Rep. of Germany ..... 453/15
2505526 11/1982 France ..... 453/9

*Primary Examiner*—Joseph J. Rolla
*Assistant Examiner*—Edward S. Ammeen
*Attorney, Agent, or Firm*—Diller, Ramik & Wight

[57] ABSTRACT

The coin separator includes a first coin passage having an inclined rail on which two coins having larger and smaller diameters are transferred. A first inclined wall is formed sidewise of the inclined rail. An upper end of the first inclined wall is inclined at a predetermined angle toward the outside of the first coin passage and the height of the first inclined wall is generally larger than the diameter of a large diameter coin. A second inclined wall is formed upstream of the first inclined wall. An upper end of the second inclined wall is inclined at a predetermined angle toward the outside of the first coined passage. The predetermined angle of the second inclined wall is greater than that of the first inclined wall and the height of the second inclined wall is generally larger than the diameter of a small diameter coin. A wall projects from a position located opposite to the second inclined wall to the inside of the first coin passage. A second coin passage is in communication with the downstream end of the inclined rail and a third coin passage is provided downward of the projecting wall. A projection is provided on the inclined surface of the second inclined wall located opposite to the projecting wall and projecting toward the inside of the first coin passage with a height decreasing in the downstream direction of the second inclined wall to effect large and small diameter coin separation.

2 Claims, 10 Drawing Sheets

A COIN SEPARATOR HAVING A PROJECTING WALL FOR AUGMENTING THE SEPARATION OF COINS OF DIFFERENT DIAMETERS

BACKGROUND OF THE INVENTION

The present invention generally relates to a coin separator usable for an automatic vending machine, a coin exchanger, an amusement machine or the like and more particularly to an improvement relating to a coin separator for separating coins and introducing the separated coins into coin passages allocated in accordance with the kind of coins.

In general, a coin selecting apparatus includes a primary selecting unit for discriminating whether coins inserted through a coin insert slit are true or false and introducing the selected true coins and false coins separately into predetermined coin passages and a coin separator for separating the selected true coins in accordance with the kind of coins and introducing them separately into predetermined coin passages.

Specifically, the conventional coin separator for separating primarily selected true coins in accordance with the kind of coins is so constructed that an inclined rail is used for transfering the coins thereon and the coins moving on the inclined rail are then introduced into separate coin passages allocated in accordance with a difference in diameter among the transferred coins. FIG. 1 is a schematic perspective view of a conventional coin separator of the above-mentioned type and the coin separator for separating two kinds of coins A and B having larger and smaller diameters, M and O, respectively, one from another is represented by reference numeral 1.

The coin separator 1 includes a first coin passage 3 serving as coin guiding means which is formed in a sub-plate 2 adapted to cover a main plate of a coin selecting apparatus which is not shown in the drawing. The first coin passage 3 is composed of an inclined rail 4 on which coins are transferred while rolling thereon, a first inclined wall 5 inclined by a predetermined angle relative to the vertical plane extending in the direction of transference of coins, and a second inclined wall 6 formed upstream of the first inclined wall 5 in an inclined state by a predetermined angle more than the first-mentioned predetermined angle of the first inclined wall 5 relative to the vertical plane extending of transference of coins. The height L of the first inclined wall 5 is determined appreciably larger than the diameter M of a coin A having a larger diameter ($L>M$) and the height N of the second inclined wall 6 is determined appreciably larger than the diamter O of a coin B having a smaller diameter and smaller than the diameter M of a coin A having a larger diameter ($O<N<M$). On the other hand, the downstream end 4*a* of the inclined rail 4 is exposed to the upstream end 7*a* of a second coin passage 7 which extends downwardly in the vertical direction and through which a coin A having a larger diameter is introduced, while a third coin passage 8 through which a coin B having a smaller diameter is introduced in the vertical direction is provided in an area located sidewards of the inclined wall 4 in the proximity of the downstream end 6*b* of the second inclined wall 6 in such a manner that the upstream end 8*a* of the third coin passage 8 is communicated with the interior of the first coin passage 3. Further, the main plate (not shown) adapted to cover the sub-plate 2 is formed with a projected wall 9 serving as first coin posture changing means on the upstream side of the first coin passage 3 so as to tilt toward the inclined walls 5 and 6 a coin which is passing through the interior of the first coin passage 3.

When a coin A having a larger diameter is introduced into the first coin passage 3 in the conventional coin separator 1 as constructed in the above-described manner, it is tilted toward the inclined walls 5 and 6 due to the presence of the projected wall 9. Since the diameter M of the coin A is dimensioned larger than the height N of the second inclined wall 6, the coin B comes in contact with the upper edge 5*a* of the first inclined wall 5 and it is then transferred to the downstream side of the inclined rail 4 while maintaining the foregoing state until it is introduced into the second coin passage 7. Further, when the coin B having a smaller diameter is introduced into the first coin passage 3, it is likewise tilted toward the first and second inclined walls 5 and 6 due to the presence of the projected wall 9. At this moment, since the diameter O of the coin B is dimensioned smaller than the height N of the second inclined wall 6, it is tilted directly toward the inclined surface 6*a* of the second inclined wall 6 to come in contact therewith and it is then transferred along the surface of the second inclined wall 6 toward the downstream end 6*b* of the same while maintaining the foregoing state. Thereafter, the coin B abuts against a triangular wall 10 which is defined by the downstream end 6*b* of the second inclined wall 6 and the first inclined wall 5 whereby movement of the coin B is interrupted. Once movement of the coin B having a smaller diameter O in the direction downstream of the inclined rail 4 is interrupted, the coin B is allowed to slide toward the upstream end 8*a* of the third coin passage 3 under the effect of a component of its dead weight active along the inclined surface 6*a* of the second inclined wall 6 until it is introduced into the third coin passage 8.

As shown in FIG. 2 which is a cross-sectional view of the conventional coin separator 1, when the coin B having a smaller diameter O is introduced into the first coin passage 3, it is tilted toward the second inclined wall 6 due to the presence of the projected wall 9 which is formed on the main plate 11 and comes in contact with the inclined surface 6*a* of the inclined wall 6. As will be apparent from FIG. 3 which is a sectional view of the coin separator 1 taken in line C—C in FIG. 2, when the coin B is brought in contact with the inclined surface 6*a* of the inclined wall 6, it tends to be sprung back under the effect of reaction force developed on the inclined surface 6*a*, causing it to be raised up again from the inclined state as represented by an arrow mark F. Thus, it is incorrectly transferred further on the inclined rail 4 without an occurence of abutting against the triangular wall 10 and thereby it is introduced into the second coin passage 7 by mistake.

SUMMARY OF THE INVENTION

The present invention has been made with the foregoing problem inherent to the conventional coin separator in mind and its object resides in providing a coin separator which assures that an occurrence of incorrect separating is reduced as far as possible and stable separating operation is performed.

Other object of the present invention is to provide a rail type coin separator which assures that initial characteristics relative to separating accuracy are maintained for a long period of time.

Another object of the present invention is to provide a coin separator which assures that an expenditure required for maintaing and inspecting operations is reduced remarkably.

To accomplish the above objects, the present invention provides a coin separator comprises coin guiding means including inclined walls inclined at a predetermined angle relative to the vertical plane extending of transference of coins so as to allow a plurality of coins having a different diameter respectively to be slantwise dislaced downwardly, first coin posture changing means for tilting toward the inclined walls which has been transferred from the upstream side of the coin guiding means so as to change the posture of transference of the tilted coin, and second coin posture changng means for allowing the coin adapted to be tilted toward the inclined walls to be gradually brought in contact with the inclined walls, whereby the coin of which posture has been changed by the first coin posture changing means is gradually brought in contact with the inclined surface of the inclined wall without any occurrence of spring-back of the coin away from the inclined wall.

Other objects, features and advantages of the present invention will become readily apparent from a reading of the following description which has been made with reference to the accompanying drawings.

DESCRIPTION OF THE PREFERRED EMBODIMENTS

Now, the present invention will be described in a greater detail hereunder with reference to the accompanying drawings which illustrate preferred embodiments thereof.

Figure 1:
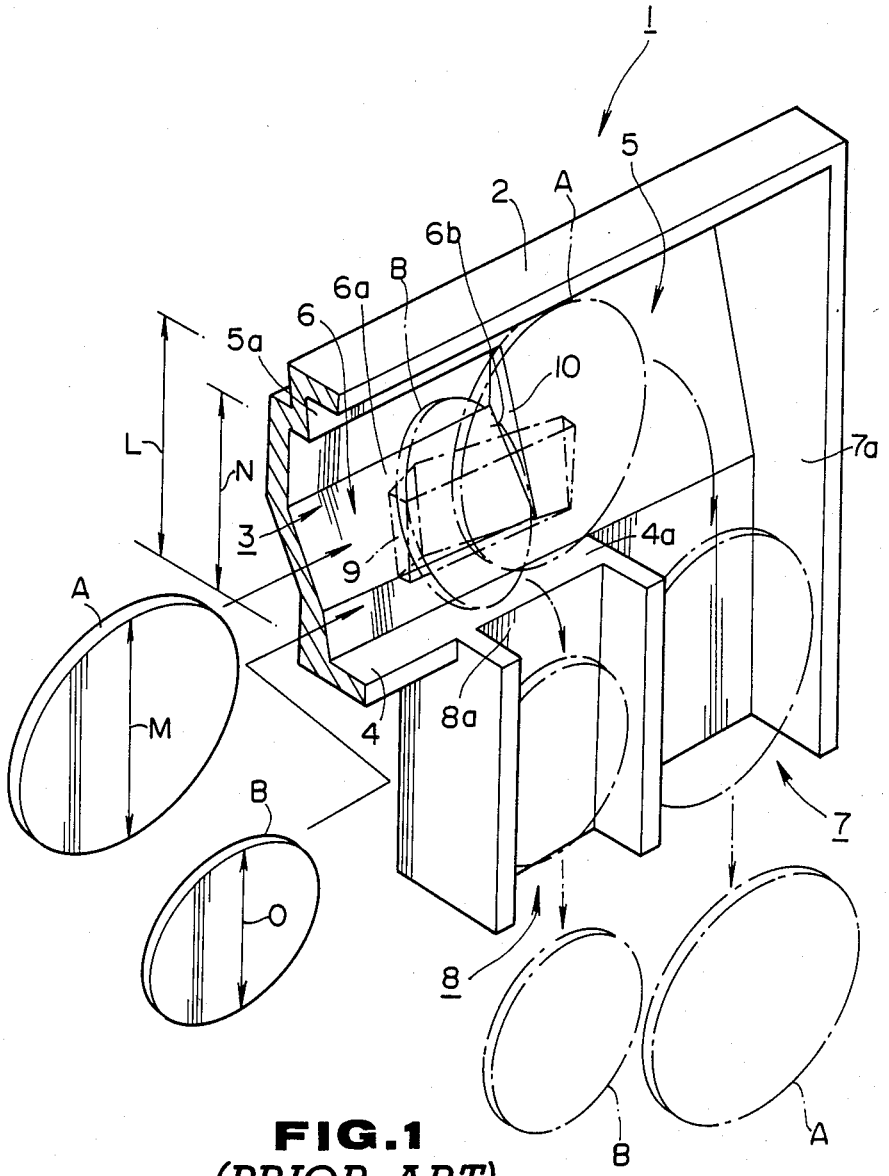
FIG.1 (PRIOR ART)
FIG. 1 is a schematic perspective view of a conventional coin separator.
Figure 2:
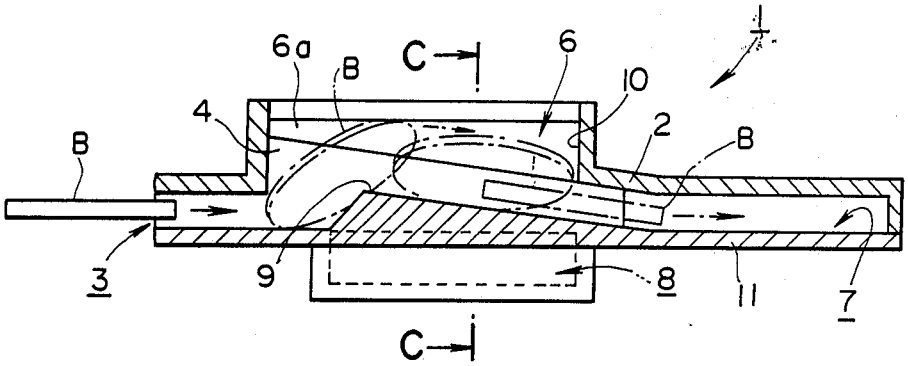
FIG. 2 (PRIOR ART)
FIG. 2 is a cross-sectional view of the conventional coin separator in FIG. 1, particularly illustrating of a function thereof.
Figure 3:
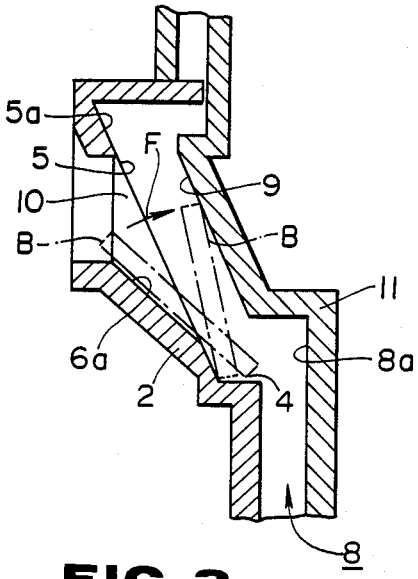
FIG. 3 (PRIOR ART)
FIG. 3 is a sectional view of the conventional coin separator taken in line C—C in FIG. 2.
Figure 4:
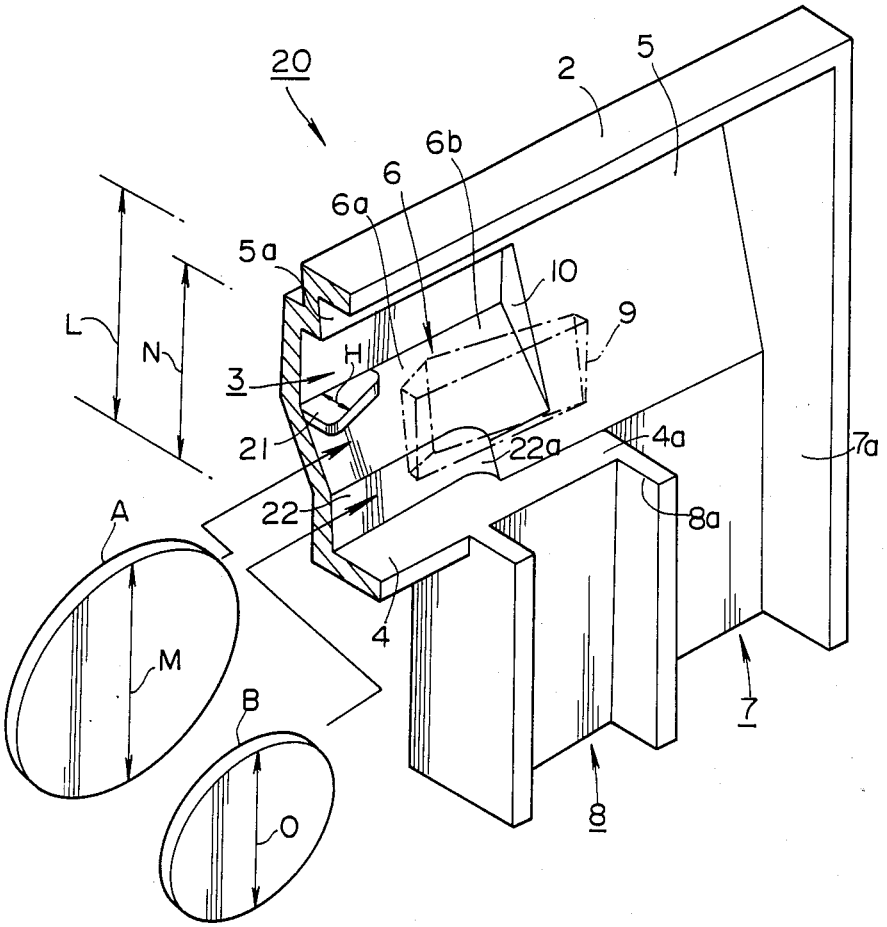
FIG. 4 is a schematic perspective view of a coin separator in accordance with an embodiment of the present invention.

FIG. 4 is a schematic perspective view of a coin separator 20 in accordance with an embodiment of the invention. Same or similar part or components to those shown in FIGS. 1 to 3 are represented by same reference numerals.

The coin separator 20 is provided with second coin posture changing means comprising a projection 21 at the upper part of the upstream portion of a second inclined wall 6 and the projection 21 is projected in the direction of width of an inclined rail 4. Further, a cutout 22 having a J-shaped contour as viewed in a plane extending from the upstream side of the second inclined wall 6 to the downstream side of the same is formed at an area where the lower part of the second inclined wall 6 is joined to the inclined rail 4. As is apparent from the drawing, the projection 21 is so designed that its height H gradually decreases as viewed from the upstream side of the second inclined wall 6 to the downstream side of the same, and the cutout 22 has an arcuate part **22*a* at an area located on the downstream side of the second inclined wall 6**.

Next, function of the coin separator 20 as constructed in the above-described manner will be described below and moreover a structure of the same will be described below in more details.

Figure 5:
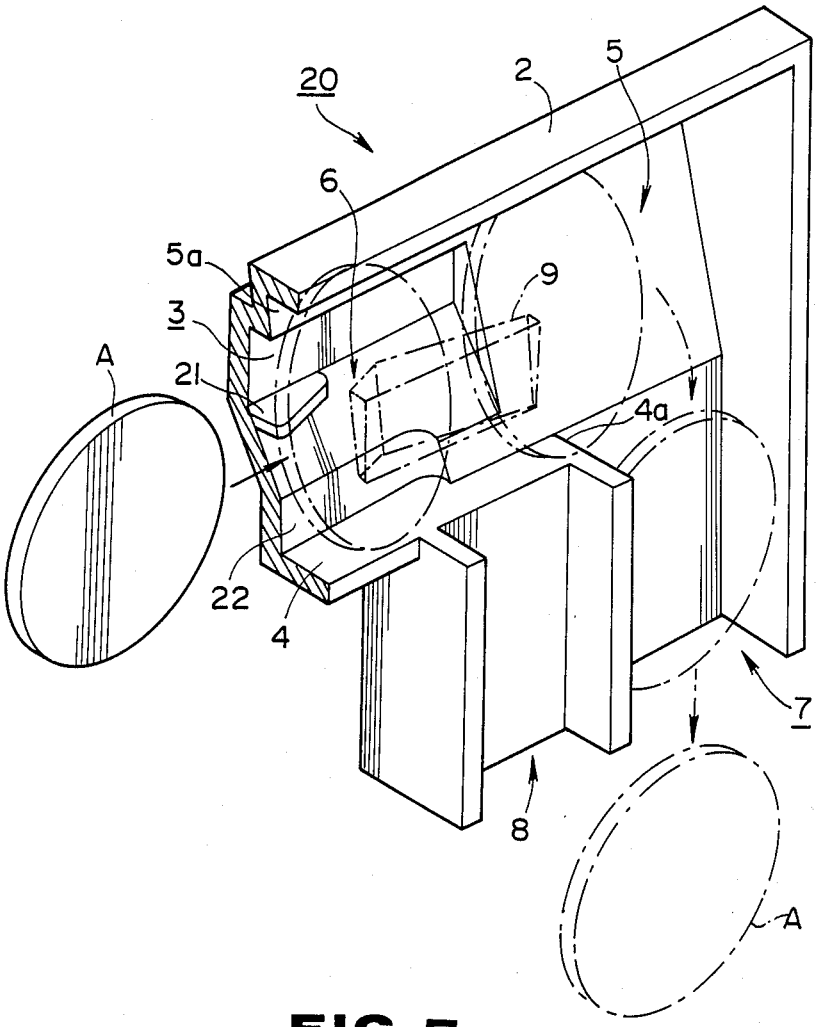
FIG. 5 is a schematic perspective view of the coin separator similar to FIG. 1, particularly illustrating a function thereof.

When a coin A having a larger diameter M is inserted into the coin separator 20 at the upstream part of the inclined rail 4, the direction of movement of the coin A having a larger diameter M is changed by means of a projected wall 9 and thereby it is tilted toward the first inclined wall 5, as shown in FIG. 5. The coin A having a larger diameter M which has been tilted in that way is transferred to the downstream side of the inclined rail 4 while coming in contact with the upper edge **5*a* of the first inclined wall 5. Consequently, the coin A having a larger diameter M is introduced into a second coin passage 7 which is communicated with the downstream part 4*a* of the inclined rail 4. Accordingly, the coin A having a larger diameter M is so separated that it is introduced into the second coin passage 7**.

Figure 6:
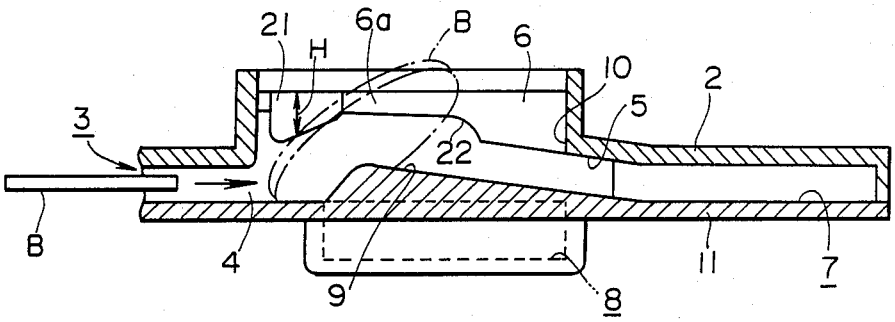
FIGS. 6 to 10 are a sectional view of the coin separator of the invention respectively, particularly illustrating a function thereof.
Figure 7:
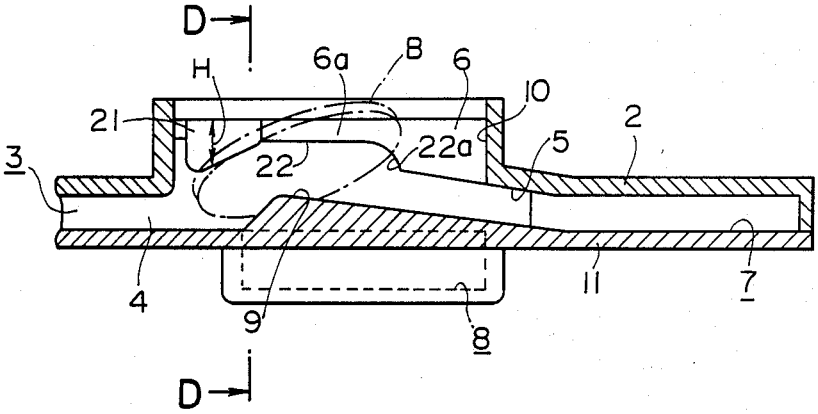
Figure 8:
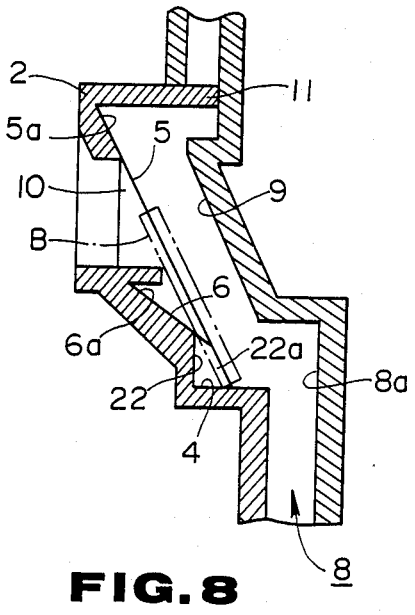
Figure 9:
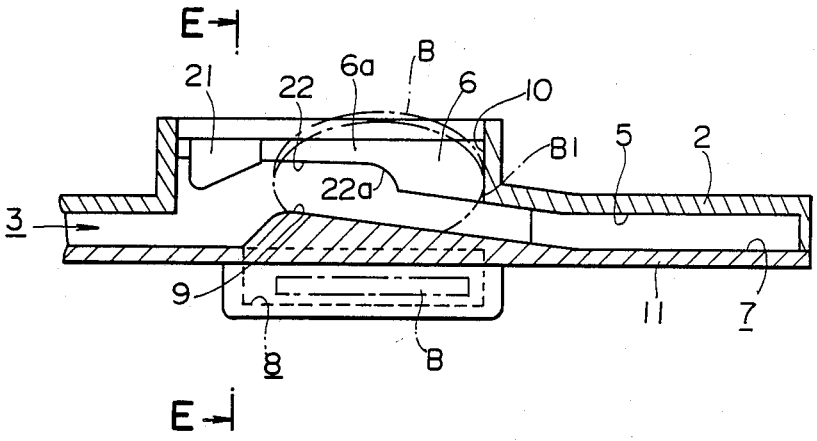
Figure 10:
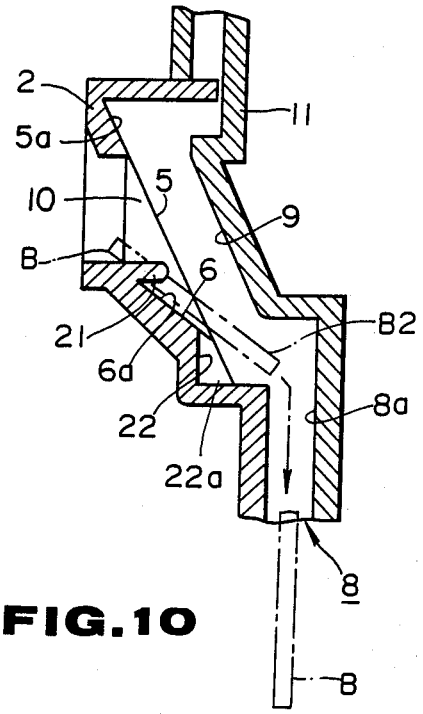

On the other hand, when a coin B having a smaller diameter O shown in FIG. 4 is inserted into the coin separator 20 on the upstream side of the inclined rail 4, the direction of movement of the coin B having a smaller diameter O is changed due to the presence of the projected wall 9 and thereby it is tilted toward the second inclined wall 6, as shown in FIG. 6 which is a sectional view of the first coin passage 3. Since the second inclined wall 6 is formed with the projection 21 at the upper part of the upstream side thereof and the cutout 22 at the lower part of the same, the upper face of the coin B comes in contact with the projection 21 and the lower face of the same comes in contact with the periphery of cutout 22. Thus, the whole upper face of the coin B which has been tilted in that way does not immediately come in contact with the the inclined surface **6*a* of the inclined wall 6 but it is gradually brought in contact with the inclined surface 6*a* of the same. Accordingly, there is no fear that the coin B is restored to the initial upright state by a spring-back function caused under the effect of reaction at the time when it contacts the inclined surface 6*a* on the second inclined wall 6 as is the case with the conventional coin separator (as illustrated in FIG. 3). Further, as shown in FIG. 7 and FIG. 8 which is a sectional view of the coin separator taken in line D—D in FIG. 7, the coin B which has been transferred along the inclined rail 4 while coming in contact with the projection 21 and the periphery 22 of the cutout 22 is transferred further in such a manner that its upper part is gradually displaced along the height H of the projection to come in contact with the inclined surface 6*a* of the second inclined wall 6 while its lower part is displaced along the arcuate part 22*a* formed at the downstream end of the cutout 22 in the direction of width of the inclined rail 4, that is, toward a third coin passage 8 (see FIG. 8). When the coin B having a smaller diameter O is transferred toward the downstream side of the inclined rail 4 while changing the direction of movement thereof in the above-described manner, a forwardmost end B1 of the coin B (as shown in FIG. 9) is caused to abut against the wall portion 10 provided at a joint part at which the second inclined wall 6 is jointed to the first inclined wall 5 whereby movement of the coin B toward the downstream side of the inclined rail 4 is inhibited. At the same time, a force which is effective for allowing the lower part B2 of the coin B (as shown in FIG. 10) to move in the direction of width of the inclined rail 4, that is, toward the upstream end 8***a* of a third coin passage 8 due to the presence of the arcuate part 22*a* of the cutout 22 is exerted on the coin B whereby the latter is introduced into the interior of the third coin passage 8 while smoothly changing the direction of movement thereof toward the third coin passage 8. Consequently, the coin B having a small diameter O is separated from the coin A having a larger diameter M whereby the former is smoothly introduced into the third coin passage 8.

As described above, the coin separator in accordance with an embodiment of the invention is so constructed that second coin posture changing means comprising a projection of which height increasingly reduce toward the downstream side of the inclined wall for guiding movement of the coin having a smaller diameter is provided on the upstream side of the inclined wall and thereby the coin adapted to be tilted onto the inclined wall is gradually brought in contact with the inclined surface of the inclined wall. Thus, such a malfunction that the coin stands upright under the influence of a spring-back function which is developed under the effect of reaction when the titled coin comes directly in contact with the inclined surface of the inclined wall does not take place. As a result, a coin separator which assures that an occurrence of incorrect separation is reduced as far as possible and required selection is achieved stably can be provided.

Figure 11:
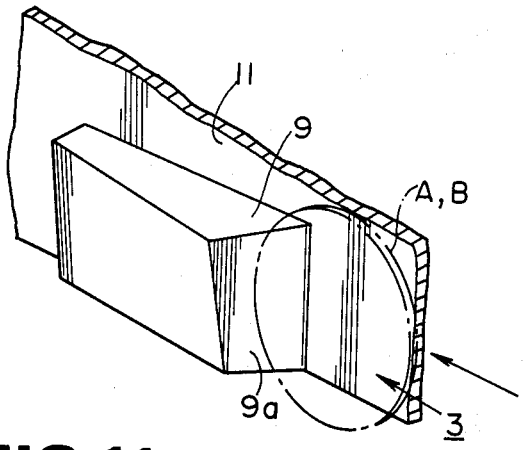
FIG. 11 is an enlarged fragmental perspective view of an essential part of the coin separator, particularly illustrating first coin posture changing means.
Figure 12:
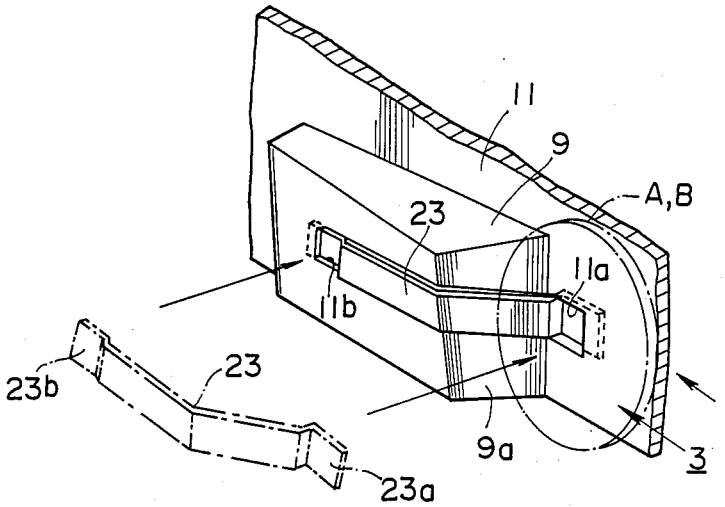
FIG. 12 is a schematic perspective view of first coin posture changing means in accordance with other embodiment of the present invention.
Figure 13:
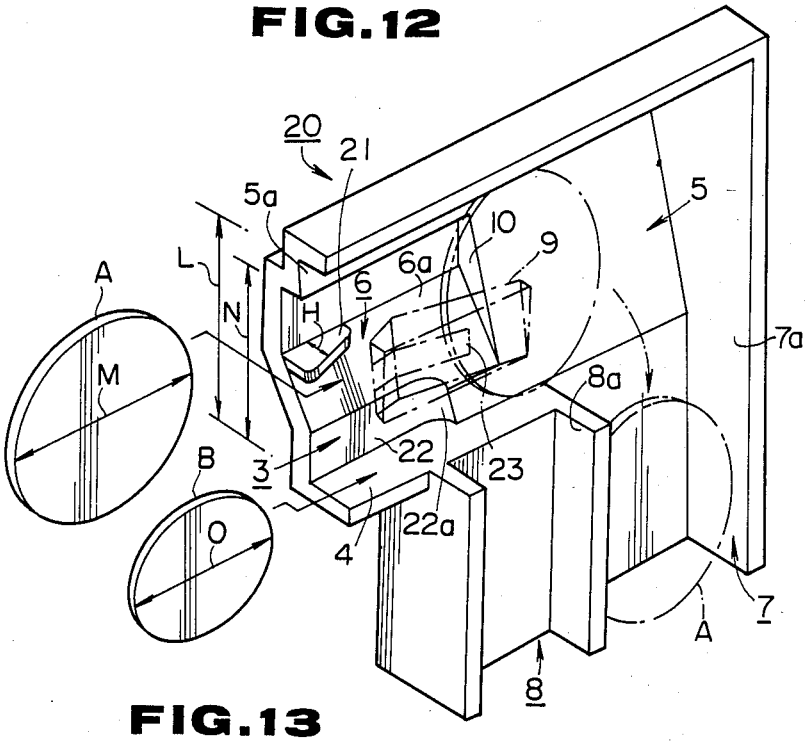
FIGS. 13 to 16 are a sectional view of the coin separator of the invention respectively, for which the first coin posture changing means in FIG. 12 is employed.

Incidentally, when the coin separator 20 as constructed in the above-described manner is put in practical use, all coins (A and B) which pass through the first coin passage 3 normally come in contact with the wall surface 9*a* of the projected wall 9 oriented upstream of the first coin passage 3, as shown in FIG. 11 which is a perspective view of an essential part of the projected wall 9, whereby the wall surface 9*a* and the peripheral area of the projected wall 9 are susceptible to wearing and injuring. Once wearing and injuring are caused on the wall surface 9*a* and the peripheral area of the projected wall 9, passing coins A and B can not be correctly tilted onto the inclined walls 5 and 6 without fail, resulting in exact separation failing to be achieved. Further, in a case where the wall surface of the projected wall 9 is worn and injured, the whole main plate 11 having the projected wall 9 formed integral therewith should be replaced with a new one. This causes maintaing and inspecting operations to become complicated and they are performed at an expensive cost. To obviate the foregoing problem, coin separator in accordance with other embodiment of the present invention is provided with a plate 23 of metallic material adapted to cover at least a part of the wall surface 9*a* on which a coin passing through the first coin passage 3 impinges, as shown in FIG. 12 which is an enlarged perspective view of an essential part of the projected wall 9. As is apparent from the drawing, the plate 23 is bent along the peripheral surface of the projected wall 9 and both end parts 23*a* and 23*b* of the plate 23 are bent in the L-shaped configuration. Further, the main plate 11 having the projected wall 9 formed integral therewith is formed with rectangular holes 11*a* and 11*b* which are located in alignment with both the end parts 23*a* and 23*b* of the plate 23. Since the main plate 11 is formed with the holes 11*a* and 11*b* and both the end parts of the plate 23 are bent in the L-shaped configuration in that way, the plate 23 can be simply attached to the projected wall 9 by resiliently bending the plate 23 along the peripheral contour of the projected wall 9 and inserting both the end parts 23*a* and 23*b* of the plate 23 into the holes 11*a* and 11*b*. Naturally, by performing the foregoing operations inversely, the plate 23 can be easily removed from the projected wall 9. If the coin separator 20 is provided with a plate 23 of metallic material so as to cover a part of the wall surface 9*a* on which coins passing through the first coin passage 3 impinge, a coin A having a larger diameter M impinges on the wall surface 9*a* of the projected wall 9 and thereby the direction of movement of the coin A is changed until it is tilted onto the first inclined wall 5, when the coin A having a larger diameter M is introduced into the first coin passage 3, as shown in FIG. 13 in which same or similar parts or components to those in FIG. 4 are identified by same reference numerals. However, since the wall surface 9*a* of the projected wall 9 is lined with the plate 23 of metallic material, the coin A having a larger diameter M does not impinge directly on the wall surface 9*a* of the projected wall 9 but impinges on the plate 23 with the result that wearing and injuring of the projected wall 9 is inhibited as far as possible. The coin A having a larger diameter M which has been tilted away from the plate 23 is transferred to the downstream side of the inclined rail 4 while coming in contact with the upper edge 5*a* of the first inclined wall 5 whereby it is introduced into the second coin passage 7, as shown in FIG. 13. Accordingly, the coin A having a larger diameter is separated from the coin B having a smaller diameter so that it is introduced into the second coin passage 7.

Figure 14:
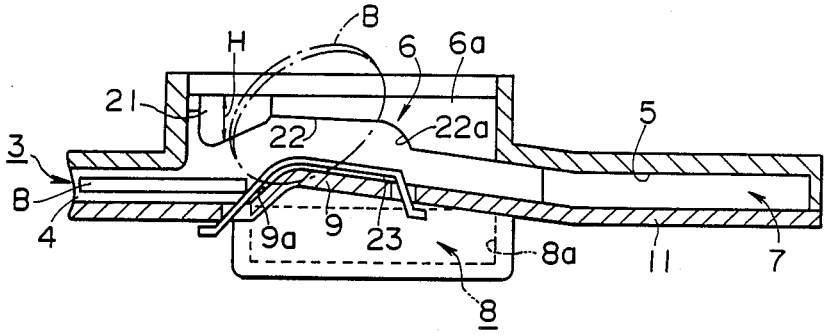
Figure 15:
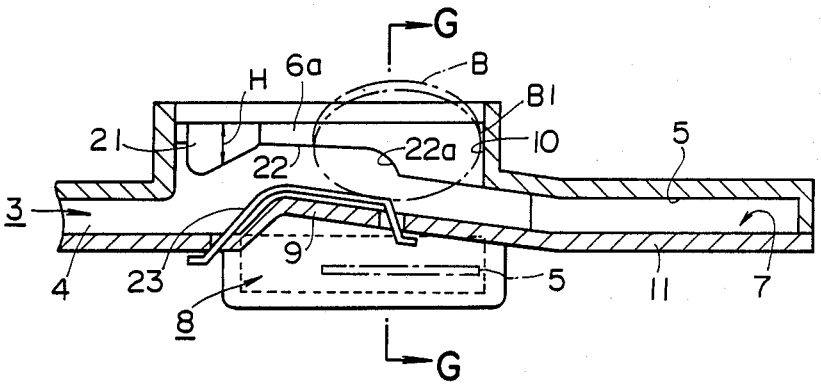
Figure 16:
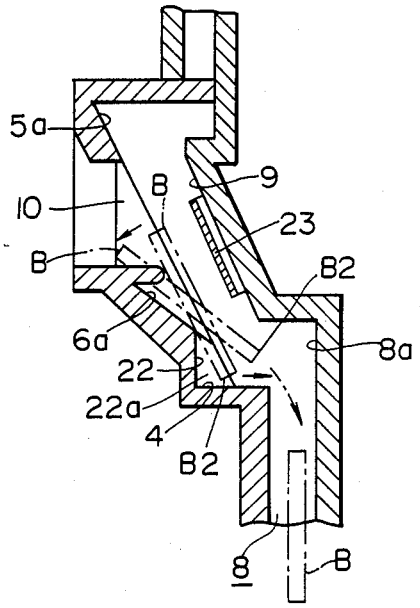

Further, when a coin B having a smaller diameter O shown in FIG. 13 is introduced on the upstream side of the inclined rail 4, the direction of movement of the coin B is changed due to the presence of the projected wall 9 until it is tilted onto the inclined wall 6, as shown in FIG. 14 which is a cross-sectional view of the first coin passage 3. Since the wall surface 9*a* of the projected wall 9 is lined with the plate 23 of metallic material, the coin B having the smaller diameter O does not impinge directly on the wall surface 9*a* of the projected wall 9 but impinges on the plate 23 in the same manner as in a case of the coin A having a larger diameter M, resulting in wearing and injuring of the projected wall 9 being inhibited as far as possible. Since the projection 21 serving as second coin posture changing means is provided at the upper part of the upstream side of the second inclined wall 6 and the cutout 22 is formed at the lower part of the second inclined wall 6, the upper face of the coin B comes in contact with the projection 21 and the lower face of the same comes in contact with the periphery of the cutout 22, when the direction of movement of the coin B is changed due to the present of the projected wall 9 and thereby it is tilted onto the second inclined wall 6 in the above-described manner. Thus, the whole upper face of the coin B which has been tilted in that way does not immediately come in contact with the inclined surface 6a of the inclined wall 6 but it is gradually brought in contact with it. As shown in FIG. 15 and FIG. 16, which is a sectional view of the coin separator taken in line G—G in FIG. 15, the upper part of the coin B to be come in contact with the projection 21 and the periphery of the cutout 22 to be transferred along the inclined rail 4 is gradually brought in contact with the inclined surface 6a of the second inclined surface 6 along the height H of the projection 21, while the lower part of the same is displaced along the arcuate part 22a at the downstream end of the cutout 22 in the direction of width of the inclined rail 4, that is, toward the third coin passage 8 until the coin B is introduced into the third coin passage 8. Specifically, as the coin B is transferred to the downstream side of the inclined rail 4 while changing the direction of movement thereof, the upper part B1 of the coin B (as shown in FIG. 15) abuts against the wall 10 at which the second inclined wall 6 is jointed to the first inclined wall 5 and thereby movement of the coin B to the downstream side of the inclined rail 4 is altered. At this moment, since a force effective for displacing the lower part B2 of the coin B having a smaller diameter O (as shown in FIG. 16) in the direction of width of the inclined rail 4, that is, toward the upstream end 8a of the third coin passage 8 is exerted on the coin B due to the presence of the arcuate part 22 of the cutout 20, the direction of movement of coin B is smoothly changed toward the third coin passage 8 and it is then introduced into the interior of the third coin passage 8. As a result, the coin B having a smaller diameter O is smoothly separated from the coin A having a larger diameter M so that it is then introduced into the third coin passage 8.

The coin separator in accordance with other embodiment of the present invention is so constructed that the projected wall serving as coin posture changing means is lined with a plate made of metallic material. With this construction, wearing and injuring of the projected wall can be inhibited as far as possible. Thus, a coin separator which assures that initial characteristics in respect of separating accuracy are maintained for a long period of time can be provided. Further, since the plate for protecting the projected wall is detachably provided on the projected wall, maintaining and inspecting operations required at the time when the plate is worn can be performed very simply. When maintaining and inspecting operations are performed, there is no need of exchanging the whole main plate having the projected wall formed integral therewith. All that is required is to exchange the plate for protecting the projected wall with a new one. Accordingly, an expenditure required for maintaining and inspecting operations can be reduced substantially.

The present invention can be embodied in various manner without departure from the spirit and main features thereof. Accordingly, the above-described embodiments are merely illustrative in all respects and it should be interpreted that they are limitative. The scope of the present invention is as defined by the appended claims and therefore it is not restricted by description of the specification. Further, it will be obvious for any expert in the art that changes or modifications involved in the scope as defined by the claims fall under the scope of the invention.

What is claimed is:

1. A coin separator comprising:

a first coin passage including an inclined rail on which two coins having larger and smaller diameters are transferred;

a first inclined wall formed sidewise of said inclined rail, an upper end of said first inclined wall being inclined at a predetermined angle toward the outside of said first coin passage, the height of said first inclined wall being generally larger than the diameter of a large diameter coin;

a second inclined wall formed upstream of said first inclined wall, an upper end of said second inclined wall being inclined at a predetermined angle toward the outside of said first coin passage, said predetermined angle of said second inclined wall being greater than that of said first inclined wall, the height of said second inclined wall being generally larger than the diameter of a smaller diameter coin;

a wall projecting from a position located opposite to said second inclined wall to the inside of said first coin passage;

a wall portion connecting the downstream end of said second inclined wall with said first inclined wall so as to change the direction of coins when the coins contact said wall portion;

a second coin passage in communication with the downstream end of said inclined rail; and a third coin passage provided downward of said projecting wall, an upstream end of said third coin passage in communication with said first coin passage, whereby coins having larger and smaller diameters transferred within said first coin passage are tilted toward said first inclined wall and said second inclined wall by said projecting wall and the tilted coins are selected according to the diameter thereof in a manner such that a larger diameter coin is guided into said second coin passage along said first inclined wall and a smaller diameter coin is guided into said third coin passage along said second inclined wall and said wall portion, a projection being provided on the inclined surface of said second inclined wall located opposite to said projecting wall, said projection projects toward the inside of said first coin passage, said projection having a height decreasing in the downstream direction of said second inclined wall, and a starting end of said projection being located at a more upstream side of said first coin passage than a starting end of said projecting wall.

2. The coin separator as defined in claim 1 wherein said projecting wall comprises a metal plate which is detachable relative to a wall surface of said projecting wall.

* * * * *